US011808552B1

(12) United States Patent
Italia

(10) Patent No.: US 11,808,552 B1
(45) Date of Patent: Nov. 7, 2023

(54) LESS LETHAL PROJECTILE SYSTEM

(71) Applicant: Richmond Italia, Fort Lauderdale, FL (US)

(72) Inventor: Richmond Italia, Fort Lauderdale, FL (US)

( * ) Notice: Subject to any disclaimer, the term of this patent is extended or adjusted under 35 U.S.C. 154(b) by 0 days.

(21) Appl. No.: 17/875,952

(22) Filed: Jul. 28, 2022

(51) Int. Cl.

| | |
|---|---|
| ***F42B 5/02*** | (2006.01) |
| ***F42B 5/145*** | (2006.01) |
| ***F42B 5/30*** | (2006.01) |
| ***F42B 5/32*** | (2006.01) |
| ***F42B 7/06*** | (2006.01) |
| ***F42B 7/08*** | (2006.01) |
| ***F42B 8/02*** | (2006.01) |
| ***F42B 8/14*** | (2006.01) |
| ***F42B 12/36*** | (2006.01) |
| ***F42B 12/46*** | (2006.01) |
| ***F42B 12/74*** | (2006.01) |
| ***F42C 19/08*** | (2006.01) |

(52) U.S. Cl.

CPC ..... *F42B 12/36* (2013.01); *F42B 5/145* (2013.01); *F42B 5/32* (2013.01); *F42B 12/46* (2013.01); *F42B 12/745* (2013.01); *F42C 19/083* (2013.01); *F42B 5/02* (2013.01); *F42B 5/30* (2013.01); *F42B 7/06* (2013.01); *F42B 7/08* (2013.01); *F42B 8/02* (2013.01); *F42B 8/14* (2013.01)

(58) Field of Classification Search

CPC .... F42B 5/00; F42B 5/02; F42B 5/145; F42B 7/02; F42B 7/06; F42B 7/10; F42B 8/00; F42B 8/02; F42B 8/10; F42B 8/12; F42B 8/14; F42B 8/16; F42B 12/36; F42B 12/46; F42B 12/50; F42B 12/745; F42B 5/30; F42B 5/32; F42B 7/08; F42B 12/72; F42B 12/74; F42B 12/76; F42C 19/08; F42C 19/083; F42C 19/0807; F42C 19/0823

USPC ..... 102/444, 446, 447, 469, 470, 471, 502

See application file for complete search history.

(56) References Cited

U.S. PATENT DOCUMENTS 2,107,034 A * 2/1938 Guthrie ..... F42B 8/10 102/446
2,196,132 A * 4/1940 Guerin ..... B65G 49/0463 134/70
3,640,013 A * 2/1972 Franklin ..... F41A 21/10 102/446

(Continued)

FOREIGN PATENT DOCUMENTS

WO WO-2012081955 A2 * 6/2012 ..... F42B 8/10

OTHER PUBLICATIONS

Machine translation of WO-2012081955-A2 (Year: 2012).*

*Primary Examiner* — James S Bergin
(74) *Attorney, Agent, or Firm* — Rosenberg, Klein & Lee

(57) ABSTRACT

A less lethal projectile system is revealed. The less lethal projectile system includes an outer shell and a projectile. A rimfire blank mounting slot is arranged at a rear end of the outer shell and offsetting a center of the outer shell. A rimfire blank is mounted in the rimfire blank mounting slot. A firing pin of a launcher strikes an edge of the rimfire blank eccentrically to push the projectile out. When the projectile is fired and reached a target, the projectile is broken and effective compositions loaded therein is scattered. The projectile is less lethal and getting broken easily for allowing the effective compositions loaded in the projectile to be spread out within a certain range.

10 Claims, 6 Drawing Sheets

(56) References Cited

U.S. PATENT DOCUMENTS

| | | | | | |
|---|---|---|---|---|---|
| 4,430,940 | A * | 2/1984 | Jermunson | F42B 8/10 | 102/446 |
| 4,442,777 | A * | 4/1984 | Greene | F42B 8/10 | 102/447 |
| 7,302,890 | B2 * | 12/2007 | Saxby | F42B 8/02 | 102/471 |
| 9,857,151 | B2 * | 1/2018 | Dionne | F42B 5/32 | |
| 9,879,954 | B2 * | 1/2018 | Hajjar | F41A 19/25 | |
| 10,466,022 | B2 * | 11/2019 | Peterson | F42B 5/307 | |

* cited by examiner

LESS LETHAL PROJECTILE SYSTEM

BACKGROUND OF THE INVENTION

Field of the Invention

The present invention relates a projectile system, especially to a less lethal projectile system.

Description of Related Art

In order to maintain order and control riots, different tools, equipment, and weapons are deployed by law enforcement people to immobilize rioters or disperse crowds. The most common way for crowd control which prevents crowds from injuries and provides deterrent effect is using air guns or paintball guns to shoot balls or projectiles filled with chili powder. When the ball or projectile hits the crowd or targets, the ball or projectile gets broken and the chili powder therein is suspended in the air to burn people's eyes, faces, and noses. People feel they are choking and unable to breathe so that they stop attacking. The irritants allow the law enforcement agencies to have better control of a man or a crowd.

The most common projectile system available in the market is a paintball gun in which a propellant used to power paintballs out is carbon dioxide or compressed air. The paintball gun requires one air tank and a loading system (often called loader). While in use, the law enforcement officers need to make sure that the air tank is filled with gas and the paintball can work well. Thus the paintball gun system can play an important role in riot control.

Moreover, most of the law enforcement personnel have carried pistols with them and sometimes they even use shotguns. However, pistols and shotguns may cause severe injuries and pose a threat to life. Paintball guns which are effective deterrents but not life-threatening are necessary in some situations that don't require the use of lethal force such as rioting. Thereby the law enforcement personnel not only need to be equipped with pistols, shotguns, and paintball guns but also have them handy and quick access. This causes burdens and troubles to the law enforcement officers.

Thus there is room for improvement and there is a need to provide a novel projectile system.

SUMMARY OF THE INVENTION

Therefore, it is a primary object of the present invention to provide a less lethal projectile system which is fired by a shotgun allotted so that the amount of equipment or guns the law enforcement officers need to perform tasks can be reduced.

It is another object of the present invention to provide a less lethal projectile system which is fired by a corresponding special launcher.

In order to achieve the above objects, a less lethal projectile system according to the present invention includes an outer shell and a projectile.

The outer shell is a cylindrical case made of injection-molded polymer and composed of a projectile mounting area located on a front end of the outer shell for loading the projectile, a rimfire blank mounting slot arranged at a rear end of the outer shell and offsetting a center of the outer shell, and a rimfire blank mounted in the rimfire blank mounting slot. A part of an edge of the rimfire blank is corresponding to and overlapped with a firing pin of a launcher so that the firing pin strikes the rimfire blank eccentrically. The rimfire blank mounting slot is communicating with the projectile mounting area.

As to the projectile, it consists of a capsule tube and a sealing member. The capsule tube is an injection-molded polymer tube used for loading effective compositions and having one end which is closed and rounded, and an opposite end open with an opening. The sealing member is mounted into the opening for closing the opening. The projectile is broken and the effective compositions loaded therein is scattered when the firing pin of the launcher strikes the edge of the rimfire blank for firing the projectile and the projectile hits a target.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, purposes and functions of the present invention more clearly and completely, please refer to the following detailed descriptions with the figures and reference signs.

Figure 1:
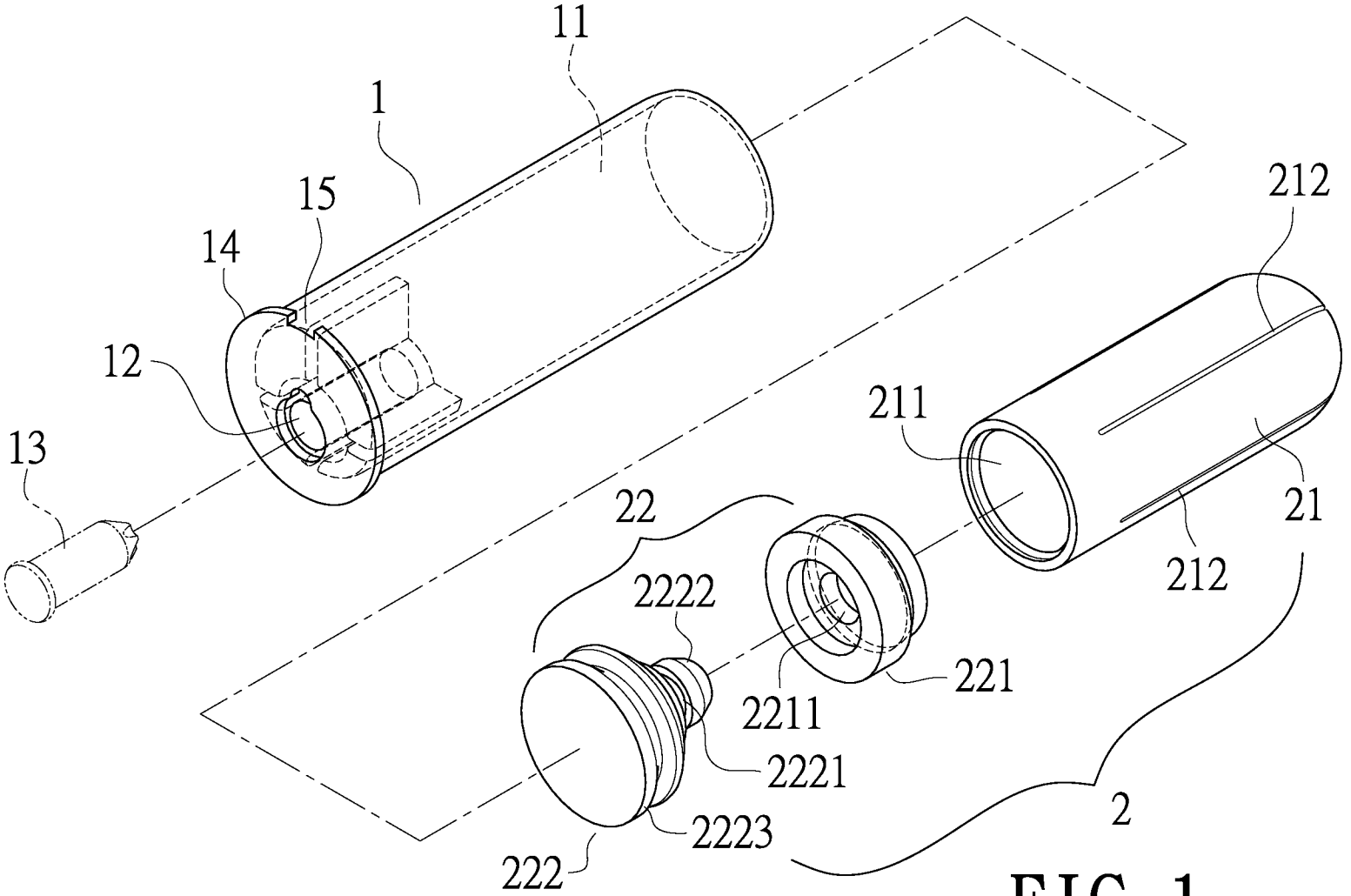
FIG. 1 is an exploded view of an embodiment of a less lethal projectile system according to the present invention.

Please refer to FIG. 1. A less lethal projectile system according to the present invention includes an outer shell 1 and a projectile 2.

Figure 5:
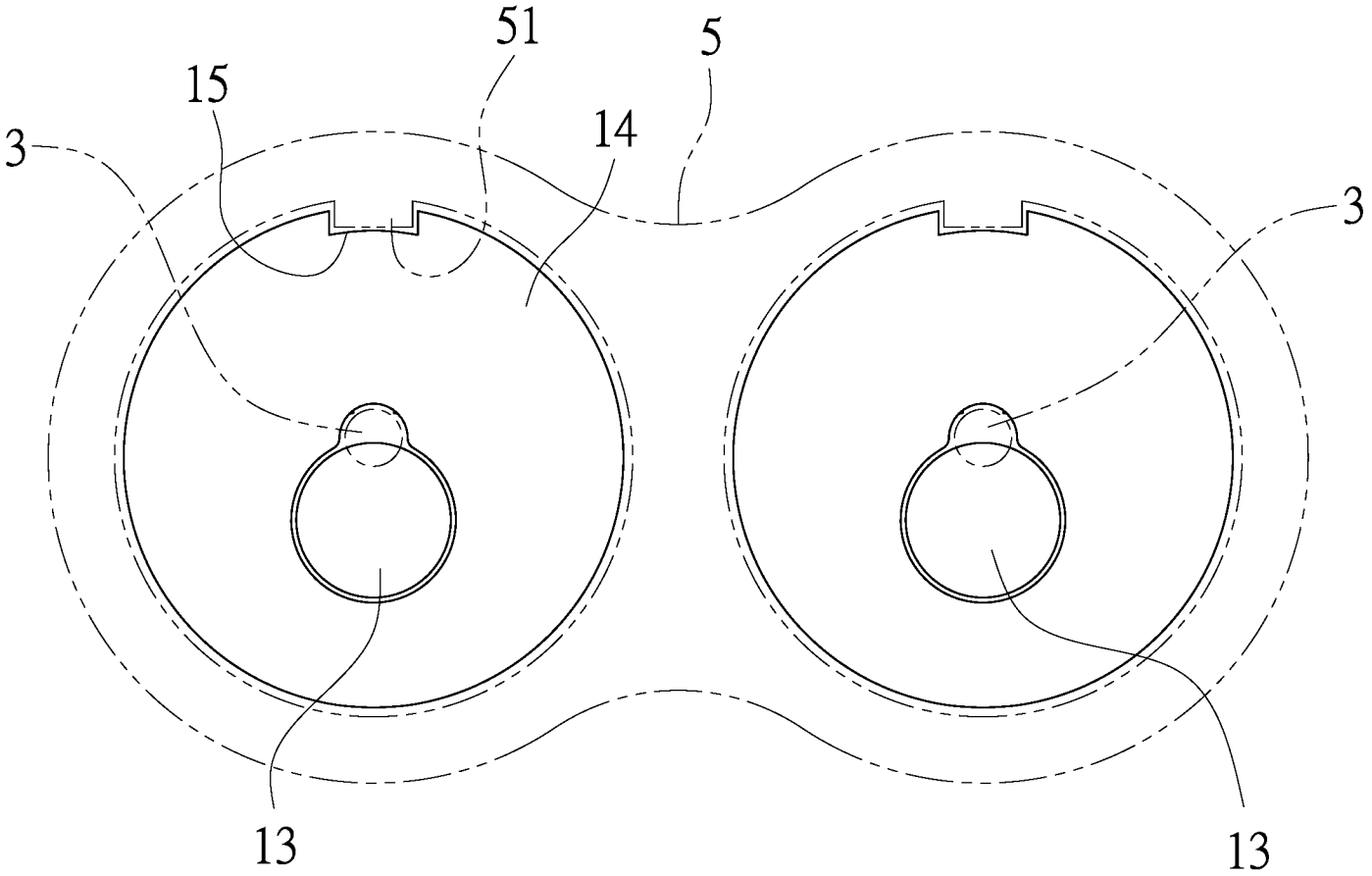
FIG. 5 is a schematic drawing showing an embodiment being loaded into a special launcher according to the present invention.
Figure 6:
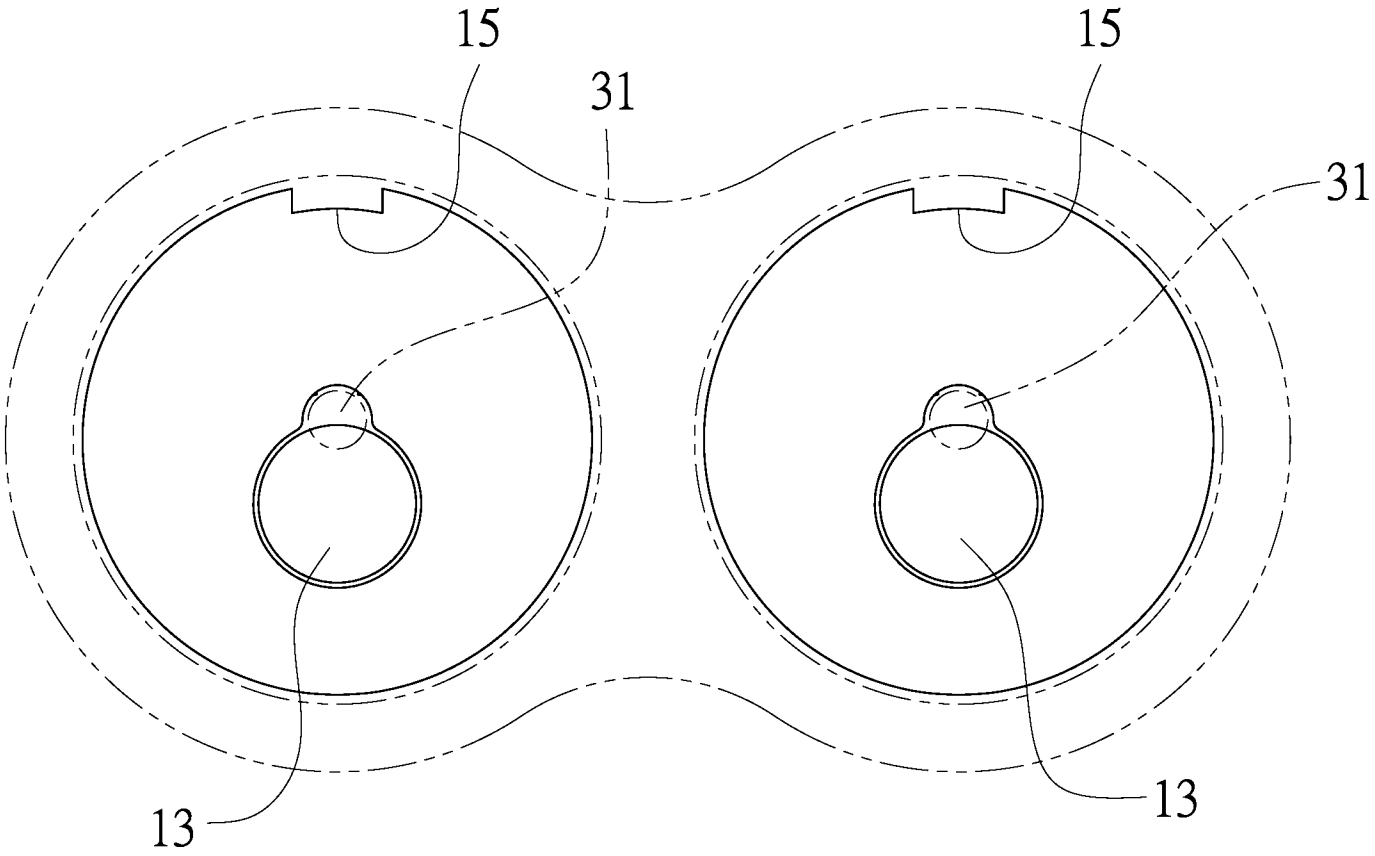
FIG. 6 is a schematic drawing showing an embodiment being loaded into a shotgun available now according to the present invention.

The outer shell 1 is a cylindrical case made of polymer and formed by injection molding. The outer shell 1 consists of a projectile mounting area 11 located on a front end of the outer shell 1 and used for loading the projectile 2, a rimfire blank mounting slot 12 arranged at a rear end of the outer shell 1 and offsetting a center of the outer shell 1, and a rimfire blank 13 mounted in the rimfire blank mounting slot 12. The outer shell 1 and a firing pin 3 of a launcher (as the dash line indicated in FIG. 5) are coaxial to each other. Thus a part of an edge of the rimfire blank 13 in the rimfire blank mounting slot 12 is corresponding to and overlapped with a part of a surface of the firing pin 3 and the firing pin 3 strikes the rimfire blank 13 eccentrically. No matter where the position of the rimfire blank 13 is after the outer shell 1 being mounted into a magazine 5 of the launcher, there is still a part of the surface of the firing pin 3 corresponding to and overlapped with the rimfire blank 13. As shown in FIG. 6, each of the firing pins 3 is still having a part of the surface corresponding to and overlapped with the corresponding rimfire blank 13 although the rimfire blanks 13 are located at different positions after two outer shells 1 being loaded into the magazine 5 of the launcher. Thus the firing pin 3 can strikes the edge of the rimfire blank 13 smoothly. The rimfire blank mounting slot 12 is communicating with the projectile mounting area 11. When the firing pin 3 hits the edge of the rimfire blank 13 to ignite powder inside the rimfire blank 13 and generate a blank blast pressure, the blank blast pressure created is transmitted to the projectile mounting area 11 and accumulated at a rear end of the projectile 2 for pushing the projectile 2 out of the projectile mounting area 11.

Figure 2:
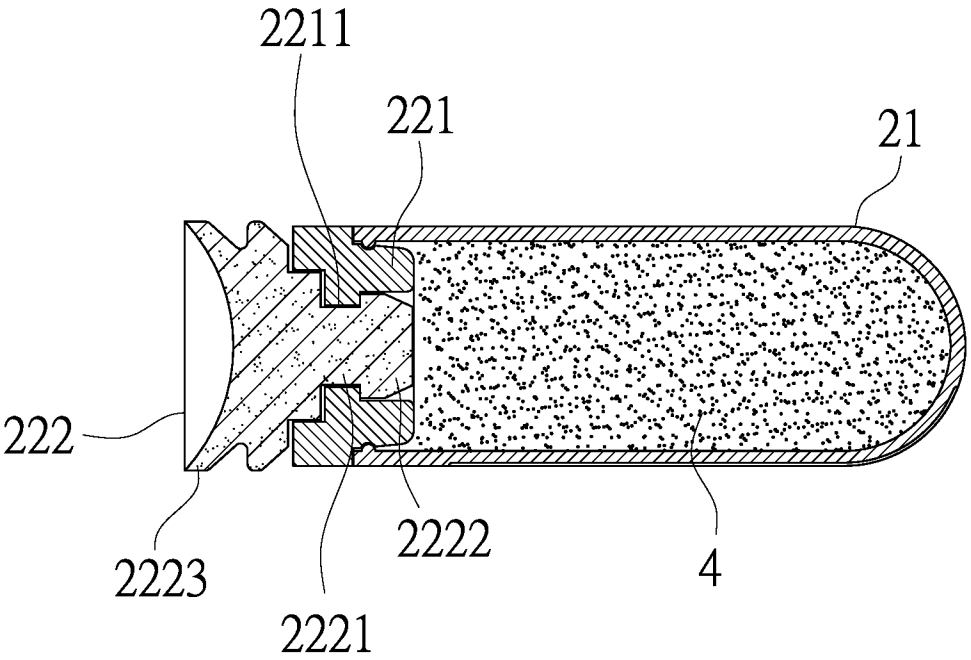
FIG. 2 is a sectional view of a projectile of an embodiment according to the present invention.
Figure 3:
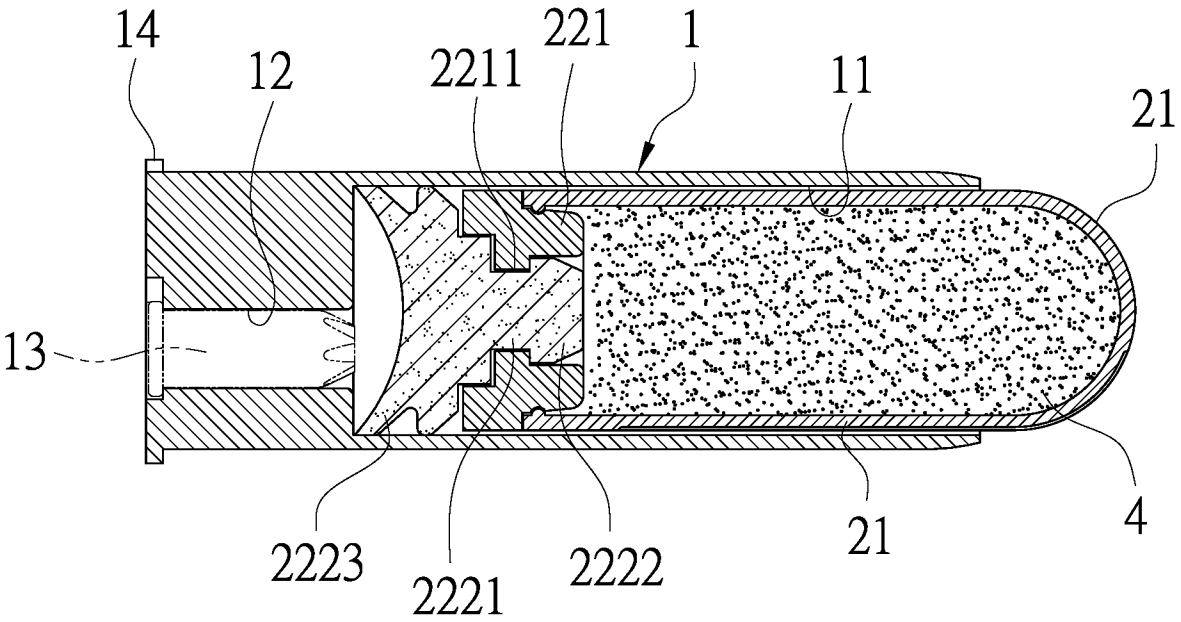
FIG. 3 is a sectional view of an embodiment according to the present invention.
Figure 4:
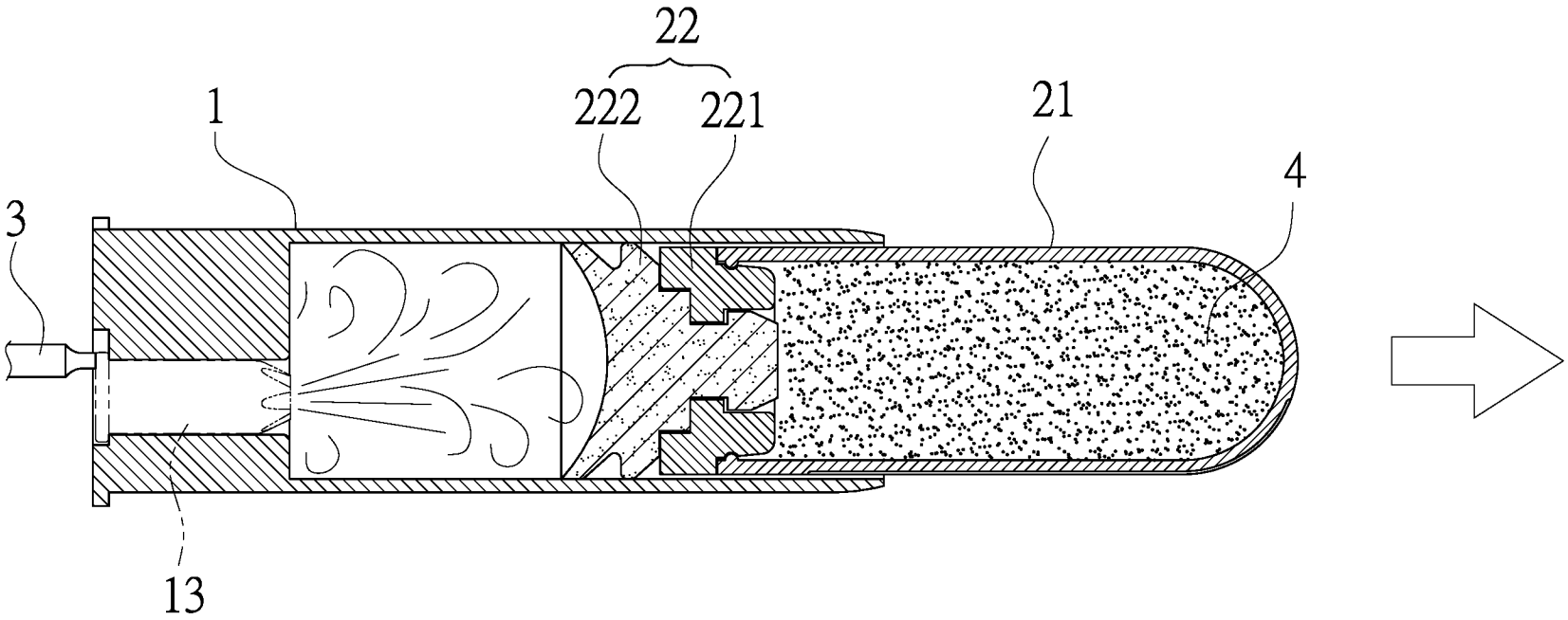
FIG. 4 is a schematic drawing showing an embodiment being fired according to the present invention.

The projectile 2 is composed of a capsule tube 21 and a sealing member 22. The capsule tube 21 is an injection-molded polymer tube with one end closed and an opposite end open. The closed end is a rounded end and the open end is provided with an opening 211. The capsule tube 21 is used for loading effective compositions 4 (as shown in FIG. 2 and FIG. 3) and the sealing member 22 is used to connect with the opening 211 for closing the opening 211. When the firing pin 3 of the launcher strikes the edge of the rimfire blank 13 for firing the projectile 2 and the projectile 2 hits a target, the capsule tube 21 of the projectile 2 is broken so that the effective compositions 4 loaded in the capsule tube 21 is spread out or attached to the target.

The effective compositions 4 can be irritant powder, irritant liquid, irritant gas, therapeutic powder, therapeutic liquid, marking powder, marking liquid, particles with deterrent effects, or their combinations.

For example, the capsule tube 21 is filled with chili powder therein. When the projectile 2 is fired and striking the target, the capsule tube 21 is getting broken and the chili powder is suspended within a range in the air. Thus people within the space feel sick because their faces, eyes, noses, and skin are irritated or burned by the chili powder. Therefore, chili powder can be used in riot control to deter or stop crowds from advancing, as well as calm tensions among rioters.

The capsule tube 21 can also be mounted with tracers therein. While the projectile 2 is fired and reaching the target, the tracer is released and attached to the target after the capsule tube 21 is shattered. Then law enforcement personnel can pursue and find their targets easily according to marking of the tracer during the following chase.

The capsule tube 21 can also be filled with medicinal powder used for treatment of animal skin disorders. When the projectile 2 is fired and hitting animals, the medicinal powder is scattered and attached to the skin of the animals. Thus the animals are medicated for treatment of skin diseases.

Since the rimfire blank 13 is disposed on the outer shell 1 eccentrically, the firing pin 3 of the launcher strikes the rimfire blank 13 in an eccentric manner. Thus the projectile 2 is only fired but not inserted into or penetrating the human body or animal's body. Thereby the present projectile system is less lethal.

Please refer to FIG. 1-3, in a preferred embodiment, the sealing member 22 includes a cover plug 221 and a buffer unit 222. The cover plug 221 is fixed on the opening 211 of the capsule tube 21 and provided with an insertion hole 2211. The buffer unit 222 is composed of a connection pin 2221 projecting from a front end of the buffer unit 222, a tapered portion 2222 formed at a distal end of the connection pin 2221, and a main body 2223. The tapered portion 2222 is tapered from one end connected with the connection pin 2221 to an opposite free end of the tapered portion 2222. A maximum outer diameter of the tapered portion 2222 is a bit larger than a diameter of the insertion hole 2211. Thereby the cover plug 221 and the buffer unit 222 will not separate from each other easily due to limiting and positioning of the tapered portion 2222 after the connection pin 2221 being inserted through the insertion hole 2211 of the cover plug 221.

In a preferred embodiment, the buffer unit 222 is made of rubber and having high strength and flexibility. A periphery of the main body 2223 of the buffer unit 222 is provided with a conical sealing edge which is able to be attached to and connected with an inner surface of the projectile mounting area 11 tightly for mounting the projectile 2 accurately in the projectile mounting area 11 under normal loaded condition. After the firing pin 3 of the launcher hits the rimfire blank 13, the blank blast pressure is created and accumulated at the rear end of the projectile 2 to push the projectile 2 out smoothly.

In a preferred embodiment, an outer surface of a wall of the capsule tube 21 is provided with a plurality of shallow grooves 212 so that the capsule tube 21 is getting broken easier after the projectile 2 is fired and reached the target.

In a preferred embodiment, the outer shell 1 further includes a projecting rim 14 located around a periphery of a bottom of the rear end of the outer shell 1 and at least one notch 15 formed on the projecting rim 14. As shown in FIG. 5, the magazine 5 of the special launcher is provided with a protrusion 51 corresponding to the notch 15 of the outer shell 1. Thus the magazine 5 of the launcher only allows the present less lethal projectile system to be loaded therein while shotgun shells which kill and wound people are unable to be loaded into the magazine 5. Moreover, the arrangement of the notch 15 has not effect on loading of the present less lethal projectile system in shotgun magazines available now. In other words, the shotgun shells used now can't be loaded into the magazine 5 of the special launcher of the present less lethal projectile system for firing but the present less lethal projectile system can be loaded into the magazine of the shotguns used now for firing.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A less lethal projectile system comprising an outer shell and a projectile;

wherein the outer shell is a cylindrical case made of injection-molded polymer and including a projectile mounting area located on a front end of the outer shell and used for loading the projectile, a rimfire blank mounting slot arranged at a rear end of the outer shell and being offset from a longitudinal axis of the outer shell, and a rimfire blank mounted in the rimfire blank mounting slot; wherein a part of an edge of the rimfire blank is disposed in correspondence with and overlaps with a firing pin of a launcher so that the firing pin strikes the rimfire blank eccentrically; wherein the rimfire blank mounting slot communicates with the projectile mounting area;

wherein the projectile includes a capsule tube and a sealing member; the capsule tube is an injection-molded polymer tube used for loading non-lethal compositions and having one end which is closed and rounded, and an opposite end open with an opening; the opening being closed with the sealing member; wherein the projectile is broken and the non-lethal compositions loaded therein is scattered when the firing pin of the launcher strikes the edge of the rimfire blank for firing the projectile and the projectile hits a target.

2. The system as claimed in claim 1, wherein the sealing member includes a cover plug and a buffer unit; the cover plug is fixed in the opening of the capsule tube and provided with an insertion hole; the buffer unit includes a connection pin projecting from a front end of the buffer unit and a tapered portion formed at a distal end of the connection pin; wherein an outer diameter of the tapered portion is larger than a diameter of the insertion hole so that the cover plug and the buffer unit are unable to be separated from each other easily due to the connection pin being limited and positioned by the tapered portion after the connection pin being inserted through the insertion hole of the cover plug.

3. The system as claimed in claim 2, wherein the buffer unit is made of rubber and having high strength and flexibility; a periphery of a main body of the buffer unit is provided with a conical sealing edge which is able to be attached to and connected with an inner surface of the projectile mounting area tightly for mounting the projectile accurately in the projectile mounting area under normal loaded condition; after the firing pin of the launcher hits the rimfire blank, a blank blast pressure is created and accumulated at the rear end of the projectile to push the projectile out smoothly.

4. The system as claimed in claim 3, wherein an outer surface of a wall of the capsule tube is provided with a plurality of shallow grooves for allowing the capsule tube to get broken easier after the projectile being fired and impacting the target.

5. The system as claimed in claim 4, wherein the non-lethal composition is selected from the group consisting of irritant powder, irritant liquid, irritant gas, therapeutic powder, therapeutic liquid, marking powder, marking liquid, particles with deterrent effects, and combinations thereof.

6. The system as claimed in claim 5, wherein a projecting rim is disposed on a periphery of a bottom of the rear end of the outer shell and at least one notch is formed on the projecting rim.

7. The system as claimed in claim 3, wherein the non-lethal composition is selected from the group consisting of irritant powder, irritant liquid, irritant gas, therapeutic powder, therapeutic liquid, marking powder, marking liquid, particles with deterrent effects, and combinations thereof.

8. The system as claimed in claim 7, wherein a projecting rim is disposed on a periphery of a bottom of the rear end of the outer shell and at least one notch is formed on the projecting rim.

9. The system as claimed in claim 3, wherein a projecting rim is disposed on a periphery of a bottom of the rear end of the outer shell and at least one notch is formed on the projecting rim.

10. The system as claimed in claim 1, wherein the projectile is selected from the group consisting of a pepperball for a .68 caliber launcher, a beanbag, a drone net, and a projectile that is fitted in the outer shell and light enough to be propelled by a blank blast pressure.

* * * * *